US011021838B2

(12) United States Patent
Nishimura et al.

(10) Patent No.: US 11,021,838 B2
(45) Date of Patent: Jun. 1, 2021

(54) SHEET MATERIAL AND MANUFACTURING METHOD THEREOF

(71) Applicant: Toray Industries, Inc., Tokyo (JP)

(72) Inventors: Hajime Nishimura, Osaka (JP); Yukihiro Matsuzaki, Anpachi-gun (JP); Makoto Nishimura, Otsu (JP); Makoto Kaneko, Otsu (JP)

(73) Assignee: Toray Industries, Inc., Tokyo (JP)

( * ) Notice: Subject to any disclaimer, the term of this patent is extended or adjusted under 35 U.S.C. 154(b) by 622 days.

(21) Appl. No.: 15/504,912

(22) PCT Filed: Aug. 18, 2015

(86) PCT No.: PCT/JP2015/073106
§ 371 (c)(1),
(2) Date: Feb. 17, 2017

(87) PCT Pub. No.: WO2016/031624
PCT Pub. Date: Mar. 3, 2016

(65) Prior Publication Data

US 2017/0254018 A1 Sep. 7, 2017

(30) Foreign Application Priority Data

Aug. 28, 2014 (JP) ..... JP2014-173849
Feb. 27, 2015 (JP) ..... JP2015-038805

(51) Int. Cl.

| | |
|---|---|
| ***D06N 3/00*** | (2006.01) |
| ***D04H 1/46*** | (2012.01) |
| ***D06N 3/10*** | (2006.01) |
| ***D01F 6/62*** | (2006.01) |
| ***D04H 1/435*** | (2012.01) |
| ***D04H 1/48*** | (2012.01) |
| ***D06M 15/564*** | (2006.01) |
| ***D06N 3/14*** | (2006.01) |
| ***D01D 5/24*** | (2006.01) |
| ***D01D 5/36*** | (2006.01) |
| ***D06M 101/32*** | (2006.01) |
| ***D01F 8/06*** | (2006.01) |
| ***D01F 8/14*** | (2006.01) |
| *D01F 8/04* | (2006.01) |

(52) U.S. Cl.

CPC ..... *D06N 3/0004* (2013.01); *D01F 6/62* (2013.01); *D01F 8/06* (2013.01); *D01F 8/14* (2013.01); *D04H 1/435* (2013.01); *D04H 1/46* (2013.01); *D04H 1/48* (2013.01); *D06M 15/564* (2013.01); *D06N 3/004* (2013.01); *D06N 3/0011* (2013.01); *D06N 3/0036* (2013.01); *D06N 3/106* (2013.01); *D06N 3/14* (2013.01); *D01D 5/24* (2013.01); *D01D 5/36* (2013.01); *D01F 8/04* (2013.01); *D06M 2101/32* (2013.01); *D06N 2201/02* (2013.01); *D06N 2203/068* (2013.01); *D06N 2209/1635* (2013.01); *D06N 2211/28* (2013.01); *D10B 2501/043* (2013.01)

(58) Field of Classification Search

CPC ..... D06N 3/0004; D06N 3/14; D06N 3/004; D06N 3/0036; D06N 3/0011; D06N 2209/1635; D06N 2203/068; D06N 2201/02; D06N 3/106; D06N 2211/28; D06M 15/564; D06M 2101/32; D04H 1/48; D04H 1/435; D04H 1/46; D01F 8/14; D01F 8/06; D01F 6/62; D01F 8/04; D10B 2501/043

See application file for complete search history.

(56) References Cited

U.S. PATENT DOCUMENTS

| | | | | |
|---|---|---|---|---|
| 4,756,947 | A * | 7/1988 | Nishikawa | C08G 18/4833 428/151 |
| 5,882,794 | A * | 3/1999 | Hernandez | D02G 3/00 428/376 |
| 5,997,980 | A * | 12/1999 | Matoba | D01D 5/24 428/85 |
| 2013/0005848 | A1 | 1/2013 | Koide et al. | |

FOREIGN PATENT DOCUMENTS

| | | | |
|---|---|---|---|
| JP | S58-156012 | A | 9/1983 |
| JP | 61-6306 | | 1/1986 |
| JP | 11-100780 | A | 4/1999 |
| JP | 2001-131877 | A | 5/2001 |
| JP | 2002-242077 | A | 8/2002 |
| JP | 2004-204358 | A | 7/2004 |
| JP | 3924360 | B2 | 3/2007 |
| JP | 4004938 | B2 | 8/2007 |
| JP | 2011-174215 | A | 9/2011 |
| JP | 2011-214210 | A | 10/2011 |

(Continued)

OTHER PUBLICATIONS

English Machine Translation JP 2012031539, retrieved from espacenet.com, Jun. 10, 2019.*
English Machine translation of JP 2004/240358.*
The First Office Action dated Jun. 28, 2018, of counterpart Chinese Application No. 201580043989.7, along with an English translation of Office Action and a Search Report.
The Second Office Action dated Nov. 15, 2018, of counterpart Chinese Application No. 201580043989.7, along with an English translation of Office Action and a Search Report.
The Third Office Action dated May 20, 2019, of counterpart Chinese Application No. 201580043989.7, along with an English translation.

(Continued)

*Primary Examiner* — Jennifer A Gillett
(74) *Attorney, Agent, or Firm* — DLA Piper LLP (US)

(57) ABSTRACT

A sheet material has good mechanical properties, flexibility, lightweight properties, and quality, and also relates to a production method therefor. The sheet material includes, as constitutional components, an elastic polymer and nonwoven fabric composed mainly of ultrafine hollow fiber with an average monofilament diameter in the range of 0.05 to 10 μm, the ultrafine hollow fiber containing 2 to 60 hollows.

6 Claims, No Drawings

(56) References Cited

FOREIGN PATENT DOCUMENTS

| | | | | |
|---|---|---|---|---|
| JP | 4869462 | B2 | | 11/2011 |
| JP | 2012031539 | A | * | 2/2012 |
| JP | 2012-057278 | A | | 3/2012 |
| JP | 2013-194f336 | A | | 9/2013 |

OTHER PUBLICATIONS

Extended European Search Report dated Dec. 7, 2017, from corresponding European Patent Application No. 15835034.8.
European Commnication dated Oct. 19, 2020, of counterpart European Application No. 15835034.8.
Machine English Translation of JP 2001-131877 A, retrieved from Esp@cenet on Jan. 5, 2021, including a revised English translation of paragraphs 0006 to 0011.

* cited by examiner

SHEET MATERIAL AND MANUFACTURING METHOD THEREOF

TECHNICAL FIELD

This disclosure relates to a sheet material having good mechanical properties, flexibility, lightweight properties, and quality, and also relates to a production method therefor.

BACKGROUND

In applications such as shoes, bags, and sports shoes, there are increased demands for sheet materials such as artificial leather having mechanical properties, flexibility, and light weight. As highly lightweight sheet materials such as artificial leather, those containing fiber structures formed from ultrafine fibers have been known for many years. Generally, known fiber structures formed of ultrafine fibers include those fiber structures containing ultrafine fibers that are produced by selectively dissolving and removing only the sea component from a fiber structure formed of sea-island type composite fibers. Although those methods can produce a fiber structure of ultrafine fibers, they cannot avoid the problem of not being able to ensure sufficient lightness because the number of interfiber voids is largely decreased during such processing steps as selective removal of the sea component and compression performed for thickness adjustment. To solve this problem, there is a known solution of using a fiber structure of hollow fibers as a sheet material.

Specifically, a study proposes artificial leather that includes polyester based hollow fiber having an apparent fineness of 2.0 deniers and containing only one hollow with a hollowness rate of 40% to 85% (see Japanese Patent No. 3924360).

In addition, another study proposes a base material for artificial leather composed mainly of an elastic polymer and a nonwoven fabric that includes: (A) ultrafine fiber with a monofilament fineness of 0.5 dtex or less and (B) fiber with a monofilament fineness of 5 dtex or less whose cross section contains 5 to 50 hollows with a total hollow area ratio in the range of 25% to 50% and a single hollow's area ratio of 5% or less, that are entangled with each other to form a three dimensional structure with a weight ratio between the ultrafine fiber (A) and the fiber (B) in the range of 20/80 to 80/20 (see Japanese Unexamined Patent Publication (Kokai) No. 2002-242077).

Still another study proposes an artificial leather base composed mainly of an elastic polymer and nonwoven fabric formed of hollow fiber whose cross section contains 5 to 50 hollows (see Japanese Patent No. 4004938), but the material has a large monofilament fineness of 3.5 decitex and a poor flexibility. Furthermore, another study proposes artificial leather formed of ultrafine fiber having a monofilament fineness of 0.1 decitex or less and having hollows (see Japanese Patent No. 4869462).

The fibers used to constitute the hollow fiber based artificial leather obtained by the proposals described above, however, have a monofilament fineness of 0.1 dtex and only one hollow is contained at maximum, resulting in low fiber cross-sectional stability.

Thus, in view of the problems with the prior art described above, it could be helpful to provide a sheet material having good mechanical characteristics, flexibility, lightweight property, and quality, and a production method therefor.

It could also be helpful to provide artificial full grain leather having good mechanical properties, flexibility, lightweight properties, and quality, and having high bending resistance.

SUMMARY

We thus provide artificial leather in the form of a sheet material that includes, as constitutional components, an elastic polymer and nonwoven fabric composed mainly of ultrafine hollow fiber with an average monofilament diameter of 0.05 to 10 μm, the ultrafine hollow fiber containing 2 to 60 hollows.

Preferably, the aforementioned ultrafine hollow fiber has an average monofilament diameter in the range of 0.1 to 6 μm.

Preferably, the sheet material is artificial leather having a nap on at least one surface.

Preferably, the sheet material is artificial full grain leather.

Ultrafine hollow fiber can be formed from composite fiber having a structure that has poorly soluble island component regions contained in a highly soluble sea component region and further has highly soluble sea component regions in each island component region.

A sheet material suitable for artificial leather having good mechanical characteristics, similar to those of solid fibers, high flexibility, and lightweight properties attributed to hollow fiber can be produced by applying ultrafine fiber containing hollows to the production of artificial leather.

If the sheet material is adopted, highly bending resistant artificial full grain leather having good mechanical characteristics, similar to those of solid fibers, high flexibility, lightweight properties attributed to hollow fiber, and high quality attributed to increased fiber flexibility can be produced by applying ultrafine fiber containing hollows to the production of artificial full grain leather.

DETAILED DESCRIPTION

The sheet material is one that includes, as constitutional components, an elastic polymer and nonwoven fabric composed mainly of ultrafine hollow fiber with an average monofilament diameter of 0.05 to 10 μm, the ultrafine hollow fiber containing 2 to 60 hollows.

It is important for the ultrafine hollow fiber containing hollows to be used to constitute the sheet material and form nonwoven fabric to have an average monofilament diameter of 0.05 to 10 μm. Having an average monofilament diameter of 0.05 μm or more allows the sheet material to maintain an adequate mechanical strength, whereas having an average monofilament diameter of 10 μm or less ensures flexibility in artificial leather. The average monofilament diameter is more preferably 0.1 to 6 μm.

The polymers usable to constitute ultrafine hollow fiber containing hollows to be used to constitute the sheet material and form nonwoven fabric include, for example, polyester, polyamide, polyolefin, and polyphenylene sulfide. Condensation-polymerized polymers such as polyester and polyamide, generally have a high melting point and they are preferred because sheet materials such as artificial leather produced from fiber of these condensation-polymerized polymers tend to have high performance due to good physical properties including mechanical characteristics.

Examples of the polyester include polyethylene terephthalate, polybutylene terephthalate, and polytrimethylene terephthalate. Furthermore, examples of the polyamide include nylon 6, nylon 66, nylon 610, and nylon 12.

The polymer constituting the ultrafine hollow fiber may contain additives such as particles, flame retardant, and antistatic agent.

Ultrafine hollow fiber containing hollows that can be used suitably for the artificial leather can be produced by, for example, using a composite spinning spinneret as described in Japanese Unexamined Patent Publication (Kokai) No. 2011-174215 that includes a measuring plate having a plurality of measuring holes to measure the flows of the sea and island polymer components and a distribution plate having a plurality of distribution holes provided in confluent grooves that combines the polymer flows discharged from the plurality of measuring holes to enable the formation of yarns with different cross section shapes.

It is important for the ultrafine hollow fiber containing hollows that forms the artificial leather to have 2 to 60 hollows. If there are two or more hollows, a wall (a support crossing the fiber cross section) is formed between the hollows to allow the ultrafine hollow fiber to be higher in rigidity than fiber with only one hollow, serving to prevent the deformation of the ultrafine hollow fiber.

With regard to the upper limit of the number of hollows in the case where removal of highly soluble (polymer) components is performed, such highly soluble polymer removal can be easily carried out when the number is 60 or less. The number of hollows is more preferably 3 to 40. If there are two or more hollows, the surface area is larger than in fiber having no or only one hollow, accordingly enabling easy dyeing in dark colors in a dyeing process. When applied to the production of artificial full grain leather, furthermore, this structure is preferable from the viewpoint of durability of products because it will hardly suffer from significant hollow deformation while maintaining light weight, thus leading to improved bending resistance.

The number of hollows in ultrafine fiber can be measured by, for example, a method in which a cross section perpendicular to the length direction of ultrafine fiber in artificial leather is observed at a magnification of 3,000 times by the scanning electron microscopy, followed by determining the average number of hollows existing in diameters of 30 monofilaments selected at random from a 30 μm×30 μm field of view.

The hollows referred to here may be either continuous or discontinuous in the length direction of the ultrafine fiber. From the viewpoint of surface conditions and strength, it is preferable for the side surface of the fiber to be free of holes attributed to hollows.

The cross sections of the hollows may have any desired shape such as circular and polygonal that suits a particular objective, but it is preferably circular from the viewpoint of morphological stability of the fiber cross sections. With respect to the arrangement of the hollows in a cross section, they may form concentric circles or other geometric patterns.

Furthermore, ultrafine hollow fiber containing hollows decreases in weight when nap is formed on the surface of artificial leather, and the napped threads have higher dispersibility than in hollow-free fiber, leading to improved quality and texture.

The ultrafine hollow fiber containing hollows that forms the nonwoven fabric to be used to constitute the artificial leather is preferably produced from sea-island type composite fiber. The ultrafine hollow fiber can be produced by using a highly soluble sea (outer sea) component and a poorly soluble island component that form a sea-island type composite fiber, together with another highly soluble inner sea component existing in the island component regions, thus forming what may be called a sea-island-sea type special composite fiber.

Such sea-island-sea type special composite fiber can be produced by, for example, using a composite spinning spinneret as described in Japanese Unexamined Patent Publication (Kokai) No. 2011-174215 that includes a measuring plate having a plurality of measuring holes to measure the flows of the sea and island polymer components and a distribution plate having a plurality of distribution holes provided in confluent grooves that combines the polymer flows discharged from the plurality of measuring holes to enable formation of yarns with different cross section shapes.

Ultrafine fiber containing hollows can be obtained by dissolving and removing the outer sea component and the inner sea component using a solvent or the like.

The outer sea component and the inner sea component in the sea-island-sea type composite fiber may be either the same polymer or different polymers, but from the viewpoint of easiness of hollow structure formation, it is preferable for the inner sea component to be either the same as the outer sea component or a component that can be eluted (dissolved) more easily than the outer sea component.

Sea-island-sea type composite fiber to be used for the sheet material preferably has a shrinkage rate of 10% to 40%, more preferably 12% to 35%, at a temperature of 98° C. A shrinkage rate in this range ensures improved product quality when used as artificial leather.

Specifically, the shrinkage rate is measured by first putting a load of 50 mg/dtex to a composite fiber bundle and putting a mark at the position of 30.0 cm ($L_0$). Subsequently, it is treated in hot water at a temperature of 98° C. for 10 minutes, followed by measuring the length after the treatment ($L_1$) and calculating the value of $(L_0-L_1)/L_0\times100$. Three measurements were taken and their average is adopted as the shrinkage rate.

The use of nonwoven fabric containing entangled ultrafine hollow fiber bundles (ultrafine fiber bundles) is preferred from the viewpoint of the surface uniformity and strength of artificial leather products or the like.

With respect to morphological features of the ultrafine fiber bundles, the ultrafine fibers may be slightly apart from each other, may be bonded, not bonded, or partly bonded to each other, or may be in the form of coagulated ultrafine fibers.

Nonwoven fabrics usable in the artificial leather include short fiber nonwoven fabrics produced by forming a laminated web from short fibers using a carding machine, cross-wrapper or the like, and processing it by needle punching water jet punching, or the like; long fiber nonwoven fabrics produced by spunbonding, meltblowing or the like; and nonwoven fabrics produced by using a papermaking technique. In particular, short fiber nonwoven fabrics and spunbond nonwoven fabrics are used favorably because favorable uniform thickness can be ensured.

The use of nonwoven fabric containing entangled bundles of ultrafine hollow fibers (ultrafine hollow fiber bundles) is preferred from the viewpoint of surface uniformity and strength of artificial full grain leather products or the like.

With respect to morphological features of the ultrafine hollow fiber bundles, the ultrafine hollow fibers may be slightly apart from each other, may be bonded, not bonded, or partly bonded to each other, or may be in the form of coagulated ultrafine fibers.

The nonwoven fabrics used to constitute the sheet material may contain other fibers mixed with the ultrafine hollow fibers. Such other fibers to be mixed include fibers of thermos-plastic resins such as, for example, polyester, polyamide, polyolefin, and polyphenylene sulfide.

The composite fibers preferably have a monofilament fineness of 2 to 10 dtex, more preferably 3 to 9 dtex, from the viewpoint of entangling performance in the needle-punching step.

Furthermore, the composite fibers are preferably sea-island composite fibers from the viewpoint of sense of extravagance, quality, and texture.

The nonwoven fabric may be lined with a layer of woven fabric, knitted fabric or the like, with the aim of ensuring improved strength. When the nonwoven fabric is laminated with woven or knitted fabric by needle-punching, it is preferable to adopt woven or knitted fabric of hard twist yarns to prevent the fiber constituting the woven or knitted fabric from being damaged by needle-punching. The yarns constituting the woven or knitted fabric preferably have a twist count of 700 T/m to 4500 T/m. In addition, the monofilaments constituting the woven or knitted fabric may have a fiber diameter nearly equal to or smaller than that of the ultrafine hollow fibers contained in the nonwoven fabric formed of ultrafine hollow fibers.

For the sheet material, it is important that the nonwoven fabric contain an elastic polymer. The binding effect of such an elastic polymer serves not only to prevent the ultrafine fibers from coming off from artificial leather, but also to give moderate cushioning properties.

The preferred elastic polymers include polyurethane, polyurea, polyurethane/polyurea elastomers, polyacrylic acid, acrylonitrile/butadiene elastomers, and styrene/butadiene elastomers, of which polyurethane is preferable from the viewpoint of flexibility and cushioning properties.

Useful polyurethane compounds include, for example, polyurethane compounds, and modified products thereof, produced through reaction among at least one polymer diol selected from the group of polymer diols such as polyester diols, polyether diols, polycarbonate diols, polyester polyether diols and the like, with an average molecular weight of 500 to 3,000, at least one diisocyanate selected from the group of aromatic diisocyanates such as 4,4'-diphenyl methane diisocyanate, alicyclic ones such as isophorone diisocyanate, and aliphatic ones such as hexamethylene diisocyanate, and at least one low molecule compound having two or more active hydrogen atoms selected from the group of ethylene glycol, butanediol, ethylene diamine, 4,4'-diaminodiphenyl methane and the like, which are mixed at an appropriate molar ratio.

These polyurethane based elastomers preferably have a weight average molecular weight of 50,000 to 300,000. A weight average molecular weight of 50,000 or more, more preferably 100,000 or more, and still more preferably 150,000 or more, serves to maintain the strength of the artificial leather and prevent composite fiber from coming off. Furthermore, if the weight average molecular weight is 300,000 or less, more preferably 250,000 or less, an increase in the viscosity of the polyurethane solution can be suppressed, and the nonwoven fabric can be more easily impregnated therewith.

Furthermore, the elastic polymers may contain polyester based, polyamide based, or polyolefin based elastomer resin, acrylic resin, or ethylene-vinyl acetate resin.

The elastic polymer may contain additives such as carbon black, other pigments, dye antioxidant, antioxidant, light resisting agent, antistatic agent, dispersing agent, softening agent, solidification adjustor, flame retardant, antibacterial agent, and deodorant, as required.

The elastic polymer may be either in the form of a solution in an organic solvent or in the form of a dispersion in water.

The elastic polymer preferably accounts for 5 to 200 mass % of the nonwoven fabric formed of entangled ultrafine hollow fibers. The surface state, cushioning properties, hardness, strength and the like of the artificial leather can be controlled by adjusting the content of the elastic polymer as appropriate. The content is preferably 5 mass % or more, more preferably 20 mass % or more, and still more preferably 30 mass % or more, to prevent fibers from coming off. On the other hand, the content is preferably 200 mass % or less, more preferably 100 mass % or less, and still more preferably 80 mass % or less to ensure a state in which ultrafine fibers are dispersed uniformly over the sheet surface.

The artificial leather of ultrafine hollow fibers preferably has a weight of 100 to 500 g/m$^2$. A weight of preferably 100 g/m$^2$ or more, more preferably 150 g/m$^2$ or more, ensures a sufficiently high morphological stability and dimensional stability required for artificial leather. On the other hand, a weight of preferably 500 g/m$^2$ or less, more preferably 300 g/m$^2$ or less, ensures a sufficiently high flexibility required for artificial leather.

When used for the production of artificial full grain leather, furthermore, the sheet material preferably has a weight of 100 to 1500 g/m$^2$ before forming a cover layer of an elastic polymer. A weight of preferably 100 g/m$^2$ or more, more preferably 150 g/m$^2$ or more, still more preferably 200 g/m$^2$ or more, ensures a sufficiently high morphological stability and dimensional stability required for artificial leather substrate. On the other hand, a weight of preferably 1,500 g/m$^2$ or less, more preferably 1,200 g/m$^2$ or less, still more preferably 1,000 g/m$^2$ or less, ensures a sufficiently high flexibility required for artificial leather substrates, accordingly for artificial full grain leather.

The sheet material preferably has a thickness of 0.1 to 10 mm. A thickness of preferably 0.1 mm or more, preferably 0.3 mm or more, ensures a sufficiently high morphological stability and dimensional stability. On the other hand, a thickness of preferably 10 mm or less, more preferably 5 mm or less, ensures a sufficiently high flexibility.

The sheet material preferably has a nap at least on one surface. This ensures dense touch in production of suede-like artificial leather.

It is important for the artificial full grain leather to have a cover layer (grained surface layer) of an elastic polymer formed on the sheet material. The elastic polymer used here is preferably of a polyurethane as listed above from the viewpoint of flexibility, cushioning properties and the like.

The grained surface layer preferably has a thickness of 0.03 to 3 mm, more preferably 0.05 to 0.5 mm.

The artificial full grain leather may further have second and third cover layers (grained surface layers) formed on top of the aforementioned cover layer to improve the wear resistance of the product. The second and third grained surface layers preferably have a thickness of 0.01 to 2 mm, more preferably 0.02 to 1 mm.

After the grained surface layer formation, furthermore, the artificial full grain leather preferably has a thickness of 0.2 to 12 mm, more preferably 0.4 to 5 mm.

Described below are the sheet material and a production method therefor.

The ultrafine hollow fiber containing hollows used to constitute the artificial leather may be a sea-island type composite fiber produced by using two thermoplastic resin components different in solubility in a solvent as the sea component and island component and dissolving and removing the sea component by using a solvent in a subsequent step to allow the island component to be left to form ultrafine fibers; or a splittable type composite fiber produced by alternately disposing a plurality of thermoplastic resins, radially or in layers, in the cross section thereof and splitting and separating the components to form ultrafine fibers. Such sea-island type composite fiber can be produced by, for example, using a composite spinning spinneret as described in Japanese Unexamined Patent Publication (Kokai) No. 2011-174215 including a measuring plate having a plurality of measuring holes to measure the flows of the sea and island polymer components and a distribution plate having a plurality of distribution holes provided in confluent grooves that combines the polymer flows discharged from the plurality of measuring holes to enable the formation of yarns with different cross section shapes. For the ultrafine hollow fiber, this may achieved by using distribution holes that are arranged to form an inner sea component region in each island component region in the sea-island type composite fiber.

A fiber-entangled body (nonwoven fabric) useful to constitute the sheet material can be produced through a step of forming a composite fiber web and a step of causing entanglement in the composite fiber web to provide a fiber-entangled body (nonwoven fabric). To produce artificial leather, the resulting nonwoven fabric is deprived of the highly soluble polymer component of the composite fiber through a step for its dissolution and removal or a step for physical or chemical peeling or splitting, and an elastic polymer containing polyurethane as primary component is added to the nonwoven fabric before or after the ultrafine fiber formation step or after the napping step to achieve substantial coagulation and solidification of the elastic polymer. Other steps are performed for napping to form a nap on the surface and treatment to achieve a uniform thickness. Subsequently, a dyeing step for finishing is carried out to provide a final artificial leather product.

It is important for the ultrafine hollow fiber containing hollows used to constitute the sheet material to include ultrafine hollow fibers with an average fiber diameter of 0.05 to 10 μm, each containing 2 to 60 hollows. Such hollows are preferably formed by processing precisely controlled sea-island type composite fiber, and ultrafine hollow fiber containing hollows can be obtained by forming inner sea component regions in island component regions in sea-island type fiber and subsequently dissolving and removing the inner sea component.

The composite fiber preferably has buckled crimps. This is because the buckled crimps improve the interfiber entanglement in production of short fiber nonwoven fabric, leading to an increased density and a high degree of entanglement. The use of a common stuffing-box type crimper has been preferred as a tool to form buckled crimps in such composite fiber, but to achieve a favorable crimp retention rate, it is preferable to perform appropriate adjustment of the fineness of processed yarns, crimper temperature, crimper load, pressing pressure or the like.

Such ultrafine fiber-generating fiber having buckled crimps preferably has a crimp retention rate of 3.5 to 15, more preferably 4 to 10. When producing nonwoven fabric, a crimp retention rate of 3.5 or more ensures an improved rigidity in the thickness direction of the nonwoven fabric, allowing a required entangling performance to be maintained in entangling steps such as needle-punching. On the other hand, a crimp retention rate of 15 or less ensures a high fiber-opening performance without excessive crimping in the carding step.

The crimp retention rate referred to here is expressed by the following equation:

$$\text{crimp retention rate}=(W/L-L_0)^{1/2}$$

W: crimp extinction load (the load where crimps are fully extended: mg/dtex)

L: fiber length under the crimp extinction load (cm)

$L_0$: fiber length under 6 mg/dtex (cm). A mark is put at the position of 30.0 cm.

To take measurements, first a load of 100 mg/dtex is put on a specimen and, subsequently, the load is increased by 10 mg/dtex at a time while observing the state of the crimps. The load is increased until the crimps are fully extended, and the shift of the mark (distance from the 30.0 cm mark position) is measured when the crimps are fully extended.

Dissolution and removal of the sea component and the inner sea component from the composite fiber and the ultrafine fiber, respectively, used to produce the sheet material can be performed before or after the elastic polymer addition step or after the napping step in manufacturing artificial leather.

As described above, adoptable methods of obtaining nonwoven fabric used to constitute the sheet material include entangling a fiber web by needle-punching or water jet punching, as well as spunbonding, meltblowing, and the use of papermaking technique, of which needle-punching and water jet punching have been used favorably to produce ultrafine fiber bundles as described above.

As described above, the nonwoven fabric may be laminated with woven or knitted fabric to form a united body, and needle-punching and water jet punching are preferred as a method to form such a united body.

The needles used for the needle-punching operation preferably have 1 to 9 needle barbs (notches). The use of preferably one or more needle barbs allows the fiber to be entangled efficiently. The use of preferably 9 or less needle barbs, on the other hand, prevents the fiber from being damaged significantly.

The number of composite fibers, such as in ultrafine fiber-generating fibers, caught by each barb depends on the shape of the barb and the diameter of each composite fiber. Thus, the needle used in the needle-punching step preferably has a barb shape with a kickup of 0 to 50 μm, an undercut angle of 0° to 40°, a throat depth of 40 to 80 μm, and a throat length of 0.5 to 1.0 mm.

The number of punches is preferably 1,000 to 8,000 punches/cm$^2$. If the number of punches is preferably 1,000 punches/cm$^2$ or more, high denseness and highly precise finishing can be achieved. On the other hand, if the number of punches is preferably 8,000 punches/cm$^2$ or less, deterioration in processability, damage to fibers, and decrease in strength will be prevented.

When the nonwoven fabric formed of ultrafine fiber-generating fiber is laminated with woven or knitted fabric to form a united body, the barbs of each needle for needle-punching are preferably at an angle of 90±25°, or nearly perpendicular, to the travelling direction of the woven or knitted fabric and the nonwoven fabric to prevent the weft, which can be easily damaged, from being caught.

When performing water jet punching, it is preferable to use water in a columnar form. Specifically, water is preferably squirted through a nozzle with a diameter of 0.05 to 1.0 mm under a pressure of 1 to 60 MPa.

The nonwoven fabric of composite fiber after the needle punching or the water jet punching preferably has an apparent density of 0.15 to 0.45 g/cm$^3$. An apparent density of preferably 0.15 g/cm$^3$ or more makes it possible to produce artificial leather having a sufficiently high shape stability and dimensional stability. An apparent density of preferably 0.45 g/cm$^3$ or less, on the other hand, serves to maintain adequate spaces to accommodate an elastic polymer.

To ensure a denser surface, it is preferable for the nonwoven fabric formed of sea-island-sea type ultrafine fiber-generating fibers obtained as described above to be shrunk by dry heat and/or wet heat to achieve a higher fiber density.

The solvent used to dissolve the sea component in the ultrafine fiber-generating fiber in the composite fiber or the inner sea component forming the hollow portions in the ultrafine fiber (island component) may be an aqueous solution of an alkali such as sodium hydroxide when the sea component is polylactic acid or copolymerized polyester. If the inner sea component can be dissolved and removed with the same solvent as for the sea component, this is preferable from the viewpoint of simplification of the process because ultrafine hollow fiber can be produced in one dissolution step.

Ultrafine fiber generation treatment (sea component removal treatment) can be carried out by immersing the nonwoven fabric formed of ultrafine fiber-generating fiber in a solvent and then squeezing out the liquid.

To generate ultrafine fiber, generally known instruments such as continuous dyeing machine, vibro-washer type sea component removing machine, jet dyeing machine, wince dyeing machine, and jigger dyeing machine can be used. Furthermore, the ultrafine fiber generation treatment may be performed either before the napping step or after the napping step.

The addition of an elastic polymer may be performed either before the ultrafine fiber generation step or after the ultrafine fiber generation step, or after the hollow formation step.

When polyurethane is to be added as the elastic polymer, the preferred solvents include N,N'-dimethyl formamide and dimethyl sulfoxide, but polyurethane may be used in the form of a water-dispersed polyurethane liquid prepared by dispersion in water to form an emulsion.

The elastic polymer is dissolved in a solvent to form a solution, and the elastic polymer is added to nonwoven fabric by, for example, immersing the nonwoven fabric, followed by drying to ensure substantial coagulation and solidification of the elastic polymer. When a solvent-based polyurethane solution is used, coagulation can be achieved by immersion in a solvent in which it is not soluble, whereas when a gelatinizable water-dispersed polyurethane liquid is used, coagulation can be achieved by a dry coagulation step in which gelation is performed first, followed by drying. Drying is preferably carried out by heating at an appropriate temperature where the performance of the nonwoven fabric and elastic polymer will not be impaired.

The sheet material preferably has a nap at least on one surface. In the case of the artificial full grain leather, at least one surface of the sheet material may be napped before grained layer formation. The napping treatment can be carried out by using sand paper or roll sander. The napping treatment can be carried out by using sand paper or roll sander. In particular, the use of sand paper allows a consistent, dense nap to be formed. To form consistent napping over the surface of sheet material, the use of a smaller grinding load is preferable. To reduce the grinding load, the buffing is preferably conducted by multiple-stage buffing of preferably three or more stages, and the sandpaper used in each stage is preferably JIS No. 120 to 600.

The sheet material may contain functional chemical agents such as, for example, dyes, pigments, softening agent, pilling prevention agent, antibacterial agent, deodorant, water repellent agent, light resisting agent, and weathering agent.

It is preferable for the sheet material to be dyed. For the dyeing, the use of a jet dyeing machine is preferred because it has a kneading effect to soften the artificial leather while dyeing it. The dyeing temperature is preferably 70° C. to 140° C. With respect to the dye type, the use of a disperse dye is preferred when ultrafine hollow fiber of polyester is used. In addition, reduction cleaning may be performed after the dyeing step.

Furthermore, it is preferable to add a dyeing assistant during the dyeing step with the aim of ensuring highly uniform dyeing. It may also be effective to perform a finishing step using silicone, other softening agents, antistatic agent, water repellent agent, flame retardant, light resisting agent and the like. Finishing treatment may be performed after dyeing or simultaneously with dyeing in the same bath.

Formation of a cover layer (grained layer) of an elastic polymer can be performed by, for example, a process in which polyurethane is applied over the sheet material. It is also preferable to adopt a lamination process in which an adhesive is applied over the sheet material and then a cover layer is pasted to the sheet material, followed by drying. In addition, second and third layers may be formed on top of the cover layer to improve the wear resistant. A generally known conventional method can be used for this lamination. For the grained layer formation, the coating weight is preferably 30 to 300 g/m$^2$ and more preferably 50 to 200 g/m$^2$.

The sheet material has flexibility, machine physical properties, and light weight simultaneously, and accordingly it can be used for the production of, for example, shoes, bags, sports shoes, miscellaneous goods, clothing, automotive interior materials, curtains for CDs, DVDs, and other discs, polishing cloth, cleaning tape, wiping cloth, and other industrial materials. In addition, it can serve favorably as artificial full grain leather after forming a grained surface of polyurethane on the surface.

EXAMPLES

The sheet material and a production method therefor are described below with reference to drawings.

Measuring Methods and Processing Methods for Evaluation (1) Melting Point of Polymer:

For melting point determination, the peak top temperature showing the melting of the polymer specimen in the 2nd run was measured by DSC-7 manufactured by Perkin Elmer and adopted as the melting point of the polymer. The heating rate in this test was 16° C./min, and the sample quantity was 10 mg. Two measurements were taken and their average was adopted as the melting point.

(2) Melt Flow Rate (MFR) of Polymer:

A 4 to 5 g amount of sample pellets was placed in the cylinder of an electric furnace of an MFR meter, and the amount (g) of resin extruded in 10 min under a load of 2,160 gf at a temperature of 285° C. was measured using a melt indexer (S101, manufactured by Toyo Seiki Co., Ltd.). This measuring run was repeated three times and the average of the measurements was adopted as the MFR.

(3) Average Monofilament Diameter of Ultrafine Fiber in Sheet Material:

For the determination of the average monofilament diameter, the cross section perpendicular to the thickness direction of the nonwoven fabric containing ultrafine fiber was observed at a magnification of 3,000 by a scanning electron microscope (SEM) (VE-7800, manufactured by Keyence Corporation), and 50 monofilaments were randomly selected from a field of view of 30 μm×30 μm and subjected to diameter measurement. This was carried out for three portions to provide diameter measurements from a total of 150 monofilaments, and measurements were rounded off to the nearest whole number and averaged. When the ultrafine fiber had deformed cross-sectional shape, the cross sections of monofilaments were measured first and the diameters of the monofilaments were calculated assuming that their cross sections were circular.

(4) Number of Hollows in Ultrafine Fiber:

The number of hollows was determined by a method in which a cross section perpendicular to the length direction of ultrafine fiber in the sheet material was observed at a magnification of 3,000 times by scanning electron microscopy, followed by determining the average number of hollows existing in diameters of 30 monofilaments selected at random from a 30 μm×30 μm field of view.

(5) Apparent Density of Sheet Material:

For apparent density determination, the weight ($g/m^2$) was measured according to JIS L1913 6.2 (2010) and the thickness (mm) was measured using a Peacock H (trade name, registered trademark) dial thickness gage manufactured by Ozaki Mfg. Co., Ltd. The apparent density ($g/cm^3$) was calculated from the measured weight and thickness.

(6) Flexibility of Artificial Leather:

A circular specimen with a diameter of 250 mm was cut out of an artificial leather sample and held in hand to feel the texture, followed by evaluating the flexibility in five ranks (1 to 5) according to the following criteria. A specimen ranked as 4 or higher was judged to have good flexibility.

5: Having flexibility and moderate elasticity

4: Having flexibility and slightly less elasticity

3: Having slight flexibility, but poor elasticity

2: Having no flexibility, but slight elasticity, or having slight flexibility, but no elasticity 1: Hard without flexibility and having paper-like texture without elasticity (7) Martindale Abrasion Test:

An artificial leather specimen was subjected to abrasion resistance test according to JIS L1096 (1999) 8.17.5 E-method (Martindale method) for loading on furniture (12 kPa), and the weight loss in the specimen was determined after 20,000 abrasion runs. A specimen with an abrasion loss of 10.0 mg or less was judged to have good performance.

(8) Surface Quality of Product:

The artificial leather prepared was subjected to functional evaluation by 20 male and female testers in sound health. For evaluation, the uniformity in nap length and the dispersion of napped fiber were observed and evaluated in five ranks (1 to 5) according to the following criteria. A specimen ranked as 4 or higher was judged to have good quality.

5: Having uniform nap length, sufficiently good dispersion, and good texture

4: Having slight unevenness in nap length, but good dispersion, and good texture 3: Having coexisting longer and shorter nap portions and slightly poor fiber dispersion 2: Having unevenness in nap length, significantly poor fiber dispersion, and poor texture 1: Having poor napping, scarce fiber dispersion, and rough texture (9) Flexibility of Artificial Full Grain Leather:

A circular piece with a diameter of 250 mm was cut out of an artificial full grain leather sample and held in hand to feel the texture, followed by evaluating the flexibility in five ranks (1 to 5) according to the following criteria. A specimen ranked as 4 or higher was judged to have good flexibility.

5: Having flexibility and moderate elasticity

4: Having flexibility and slightly less elasticity

3: Having slight flexibility, but poor elasticity

2: Having no flexibility, but slight elasticity or having slight flexibility, but no elasticity 1: Hard without flexibility and having paper-like texture without elasticity

(10) Buckling Resistance of Artificial Full Grain Leather:

For buckling resistance evaluation, a circular piece with a diameter of 250 mm was cut out of an artificial full grain leather sample and the circular specimen was folded in two with the grained layer inward, followed by attaching a weight of 5 kg to a position 5 cm from the fold. The specimen was left to stand for one hour and then the state of the fold was observed visually and evaluated in ranks from 5.0 to 0.0 in 0.5 increments as follows. A specimen ranked as 3.5 to 5 was judged to have good resistance quality.

5: Having no creases

4: Having a few creases, but little noticeable, and recoverable by stretching

3: Having a number of creases, but substantially recoverable by stretching

2: Having creases, but slightly recoverable by stretching

1: Having strong creases, unrecoverable by stretching

Example 1

Raw Stock

Island Component Polymer

Polyethylene terephthalate (PET) with a melting point of 260° C. and a MFR of 46.5 was used.

Sea Component Polymer

Polystyrene (PSt) with a Vicat softening temperature, measured according to JIS K7206, of 100° C. and a MFR of 120 was used.

Spinning and Stretching

The sea component polymer and the island component polymer described above were subjected to melting spinning through a sea-island type composite spinneret with 16 islands per hole and 4 inner seas per island, which had 16 islands, each containing 4 islands of the inner sea component, under the conditions of a spinning temperature of 285° C., and an island component/inner sea component/sea component ratio by weight of 55/15/30.

Then, two stage stretching at a total draw ratio of 3.0 was performed in a stretching liquid bath at a temperature of 85° C. and crimps were formed using a stuffing box type crimper to provide sea-island type composite fiber. The resulting sea-island type composite fiber had a monofilament fineness of 4.2 dtex, an ultrafine fiber diameter of 4.4 μm, and a shrinkage rate of 18.3% at a temperature of 98° C. This composite fiber was cut to a fiber length of 51 mm to provide a raw stock of sea-island type composite fiber.

Nonwoven Fabric

The above raw stock was used to produce a laminated fiber web via carding and crosslapper steps. Subsequently, the resulting laminated fiber web was needle-punched using a needle punching machine containing one needle with a total barb depth 0.075 mm under the conditions of a needle depth of 7 mm and 2,700 punches/$cm^2$, thereby producing a nonwoven fabric with a weight of 750 g/$m^2$ and an apparent density of 0.236 g/$cm^3$.

Artificial Leather

The above nonwoven fabric was shrunk in hot water at a temperature of 98° C. and impregnated with an aqueous solution of PVA (polyvinyl alcohol) with a concentration of 13%, followed by drying in hot air at a temperature of 120° C. for 10 minutes to provide nonwoven fabric containing PVA accounting for of 25 mass % relative to the mass of the nonwoven fabric. The nonwoven fabric thus obtained was immersed in trichloroethylene to dissolve and remove the sea component to provide nonwoven fabric (sea-deprived sheet) of ultrafine fiber. The resulting nonwoven fabric of ultrafine fibers (sea-deprived sheet) was immersed in a solution of polycarbonate based polyurethane in DMF (dimethyl formamide) with a solid content adjusted to 12%, followed by coagulating the polyurethane in an aqueous solution with a 30% DMF concentration. Subsequently, PVA and DMF was removed with hot water and dried in hot air at a temperature of 110° C. for 10 minutes to provide a sheet material in which polyurethane accounted for 27 mass % of the total mass of the ultrafine fibers formed of the island component. Subsequently a half splitter having an endless band knife was used to cut it into halves in the thickness direction, and the non-cut surfaces were ground in three steps using JIS #150 sand paper for napping to produce artificial leather. In addition, a circular drying machine was used and it was dyed with a disperse dye to provide artificial leather (product). The resulting artificial leather (product) had a high flexibility ranked as 5. Its Martindale abrasion weight loss was 6.5 mg and the surface quality was ranked as a high 4.7. Results are given in Table 1.

Artificial Full Grain Leather

The cut surface of the artificial leather was coated with polyether based polyurethane with a knife coater to a weight of 110 g/$m^2$ and it was coagulated in an aqueous solution with a 30% DMF concentration. Subsequently, a top layer (100 g/$m^2$) formed of polyether/polycarbonate based polyurethane on release paper was adhered to the outermost layer with an adhesive to provide artificial full grain leather.

The resulting artificial full grain leather had a high flexibility ranked as 5. Its buckling resistance was as high as 4.5. Results are given in Table 1.

Example 2

Raw Stock

Island Component Polymer and Sea Component Polymer

The same island component polymer and sea component polymer as adopted in Example 1 were used.

Spinning and Stretching

Except that the sea-island type composite fiber had a fineness of 6.1 dtex and that the ultrafine fiber had a fiber diameter of 5.5 the same procedure as in Example 1 was carried out to produce raw stock of sea-island type composite fiber from the above sea component polymer and island component polymer.

Nonwoven Fabric

The above raw stock was processed according to the same procedure as in Example 1 to provide nonwoven fabric.

Artificial Leather

A sheet material, artificial leather, and artificial leather (product) were produced by carrying out the same procedure as in Example 1 except for using the above nonwoven fabric. The resulting artificial leather (product) had a high flexibility ranked as 5. Its Martindale abrasion weight loss was 6.2 mg and the surface quality was ranked as a high 4.6. Results are given in Table 1.

Artificial Full Grain Leather

Artificial full grain leather was produced by carrying out the same procedure as in Example 1 except for using the above artificial leather. The resulting artificial full grain leather had a high flexibility ranked as 5. Its buckling resistance was as high as 4.5. Results are given in Table 1.

Example 3

Raw Stock

Island Component Polymer and Sea Component Polymer

The same island component polymer and sea component polymer as adopted in Example 1 were used.

Spinning and Stretching

Except for using a sea-island type composite spinneret with 12 islands per hole and 6 inner seas per island, which had 12 islands, each containing 6 islands of the inner sea component, sea-island type composite fiber with a fineness of 7.5 dtex, and ultrafine fiber with a fiber diameter of 7.0 μm, the same procedure as in Example 1 was carried out to produce raw stock of sea-island type composite fiber from the above sea component polymer and island component polymer.

Nonwoven Fabric

The above raw stock was processed according to the same procedure as in Example 1 to provide nonwoven fabric.

Artificial Leather

A sheet material, artificial leather, and artificial leather (product) were produced by carrying out the same procedure as in Example 1 except for using the above nonwoven fabric. The resulting artificial leather (product) had a high flexibility ranked as 4. Its Martindale abrasion weight loss was 6.0 mg and the surface quality was ranked as a high 4.1. Results are given in Table 1.

Artificial Full Grain Leather

Artificial full grain leather was produced by carrying out the same procedure as in Example 1 except for using the above artificial leather. The resulting artificial full grain leather had a high flexibility ranked as 4. Its buckling resistance was as high as 4.5. Results are given in Table 1.

Example 4

Raw Stock

Island Component Polymer and Sea Component Polymer

The same island component polymer and sea component polymer as adopted in Example 1 were used.

Spinning and Stretching

Except for using a sea-island type composite spinneret with 8 islands per hole and 48 inner seas per island, which had 8 islands, each containing 48 islands of the inner sea component, sea-island type composite fiber with a fineness of 7.6 dtex, and ultrafine fiber with a fiber diameter of 8.6 μm, the same procedure as in Example 1 was carried out to produce raw stock of sea-island type composite fiber from the above sea component polymer and island component polymer.

Nonwoven Fabric

The above raw stock was processed according to the same procedure as in Example 1 to provide nonwoven fabric.

Artificial Leather

A sheet material, artificial leather, and artificial leather (product) were produced by carrying out the same procedure as in Example 1 except for using the above nonwoven fabric. The resulting artificial leather (product) had a high flexibility ranked as 4. Its Martindale abrasion weight loss was 5.7 mg and the surface quality was ranked as a high 3.7. Results are given in Table 1.

Artificial Full Grain Leather

Artificial full grain leather was produced by carrying out the same procedure as in Example 1 except for using the above artificial leather. The resulting artificial full grain leather had a high flexibility ranked as 4. Its buckling resistance was 4.0. Results are given in Table 1.

Example 5

Raw Stock

Island Component Polymer and Sea Component Polymer

The same island component polymer and sea component polymer as adopted in Example 1 were used.

Spinning and Stretching

Except for using a sea-island type composite spinneret with 37 islands per hole and 3 inner seas per island, which had 37 islands, each containing 3 islands of the inner sea component, sea-island type composite fiber with a fineness of 3.1 dtex, and ultrafine fiber with a fiber diameter of 2.5 μm, the same procedure as in Example 1 was carried out to produce raw stock of sea-island type composite fiber from the above sea component polymer and island component polymer.

Nonwoven Fabric

The above raw stock was processed according to the same procedure as in Example 1 to provide nonwoven fabric.

Artificial Leather

A sheet material, artificial leather, and artificial leather (product) were produced by carrying out the same procedure as in Example 1 except for using the above nonwoven fabric. The resulting artificial leather (product) had a high flexibility ranked as 5. Its Martindale abrasion weight loss was 7.9 mg and the surface quality was ranked as a high 4.6. Results are given in Table 1.

Artificial Full Grain Leather

Artificial full grain leather was produced by carrying out the same procedure as in Example 1 except for using the artificial leather prepared as described above. The resulting artificial full grain leather had a high flexibility ranked as 5. Its buckling resistance was 3.5. Results are given in Table 1.

Example 6

Raw Stock

Island Component Polymer and Sea Component Polymer

The same island component polymer and sea component polymer as adopted in Example 1 were used.

Spinning and Stretching

Except for using a sea-island type composite spinneret with 160 islands per hole and 2 inner seas per island, which had 160 islands, each containing 2 islands of the inner sea component, sea-island type composite fiber with a fineness of 4.6 dtex, and ultrafine fiber with a fiber diameter of 1.5 μm, the same procedure as in Example 1 was carried out to produce raw stock of sea-island type composite fiber from the above sea component polymer and island component polymer.

Nonwoven Fabric

The above raw stock was processed according to the same procedure as in Example 1 to provide nonwoven fabric.

Artificial Leather

A sheet material, artificial leather, and artificial leather (product) were produced by carrying out the same procedure as in Example 1 except for using the above nonwoven fabric. The resulting artificial leather (product) had a high flexibility ranked as 4. Its Martindale abrasion weight loss was 8.9 mg and the surface quality was ranked as a high 4.5. Results are given in Table 1.

Artificial Full Grain Leather

Artificial full grain leather was produced by carrying out the same procedure as in Example 1 except for using the above artificial leather. The resulting artificial full grain leather had a high flexibility ranked as 4. Its buckling resistance was 3.5. Results are given in Table 1.

Example 7

Raw Stock

Island Component Polymer

Nylon 6 with a melting point of 220° C. and a MFR of 58.0 was used as island component polymer.

Sea Component Polymer

The same sea component polymer as adopted in Example 1 were used.

Spinning and Stretching

Except for using the above sea component polymer and island component polymer, the same procedure as in Example 1 was carried out to produce raw stock of sea-island type composite fiber.

Nonwoven Fabric

The above raw stock was processed according to the same procedure as in Example 1 to provide nonwoven fabric.

Artificial Leather

Artificial leather prepared from the above nonwoven fabric by the same procedure as in Example 1 was dyed with a premetalized dye (Irgalan Red 2GL) [manufactured by Ciba Specialty Chemicals Inc.] under the conditions of 4.0% owf, a bath ratio of 1:100, a pH of 7, a temperature of 90° C., and a treatment time of 60 minutes, followed by rinsing and drying to provide dyed artificial leather (product).

The resulting artificial leather (product) had a high flexibility ranked as 5. Its Martindale abrasion weight loss was 7.9 mg and the surface quality was ranked as a high 4.3. Results are given in Table 1.

Artificial Full Grain Leather

Artificial full grain leather was produced by carrying out the same procedure as in Example 1 except for using the above artificial leather. The resulting artificial full grain leather had a high flexibility ranked as 5. Its buckling resistance was 3.5. Results are given in Table 1.

Example 8

Raw Stock

Island Component Polymer

Nylon 610 with a melting point of 220° C. and a MFR of 45.0 was used as island component polymer.

Sea Component Polymer

The same sea component polymer as adopted in Example 1 was used.

Spinning and Stretching

Except for using the above sea component polymer and island component polymer, the same procedure as in Example 1 was carried out to produce raw stock of sea-island type composite fiber.

Nonwoven Fabric

The above raw stock was processed according to the same procedure as in Example 1 to provide nonwoven fabric.

Artificial Leather

Using the above nonwoven fabric, dyed artificial leather (product) was produced according to the same procedure as in Example 7.

The resulting artificial leather (product) had a high flexibility ranked as 5. Its Martindale abrasion weight loss was 7.6 mg and the surface quality was ranked as a high 4.4. Results are given in Table 1.

Artificial Full Grain Leather

Artificial full grain leather was produced by carrying out the same procedure as in Example 1 except for using the above artificial leather. The resulting artificial full grain leather had a high flexibility ranked as 5. Its buckling resistance was 4.0. Results are given in Table 1.

Example 9

Raw Stock

Island Component Polymer

The same sea component polymer as adopted in Example 7 was used.

Sea Component Polymer

PET copolymerized with 8.5 mol % of sodium 5-sulfoisophthalate having a melting point of 240° C. and a MFR of 100 was used.

Spinning and Stretching

Except for using the above sea component polymer and island component polymer, the same procedure as in Example 1 was carried out to produce raw stock of sea-island type composite fiber.

Nonwoven Fabric

The above raw stock was processed according to the same procedure as in Example 1 to provide nonwoven fabric.

Artificial Leather

Except for using the above nonwoven fabric and performing dissolution and removal of the sea component by processing it for 30 minutes with an aqueous sodium hydroxide solution with a concentration of 20 g/L heated at a temperature of 90° C., the same procedure as in Example 7 was carried out to produce dyed artificial leather.

The resulting artificial leather (product) had a high flexibility ranked as 5. Its Martindale abrasion weight loss was 8.7 mg and the surface quality was ranked as a high 4.2. Results are given in Table 1.

Artificial Full Grain Leather

Artificial full grain leather was produced by carrying out the same procedure as in Example 1 except for using the above artificial leather. The resulting artificial full grain leather had a high flexibility ranked as 4. Its buckling resistance was 3.5. Results are given in Table 1.

Comparative Example 1

Raw Stock

Island Component Polymer and Sea Component Polymer

The same island component polymer and sea component polymer as adopted in Example 1 were used.

Spinning and Stretching

Except for using a sea-island type composite spinneret with 8 islands per hole and 6 inner seas per island, which had 8 islands, each containing 6 islands of the inner sea component, sea-island type composite fiber with a fineness of 11.3 dtex, and ultrafine fiber with a fiber diameter of 10.5 μm, the same procedure as in Example 1 was carried out to produce raw stock of sea-island type composite fiber from the above sea component polymer and island component polymer.

Nonwoven Fabric

The above raw stock was processed according to the same procedure as in Example 1 to provide nonwoven fabric.

Artificial Leather

A sheet material, artificial leather, and artificial leather (product) were produced by carrying out the same procedure as in Example 1 except for using the above nonwoven fabric. The resulting artificial leather (product) had a poor flexibility ranked as 3. Its Martindale abrasion weight loss was 5.4 mg and the surface quality was ranked as 3.3. Results are given in Table 1.

Artificial Full Grain Leather

Artificial full grain leather was produced by carrying out the same procedure as in Example 1 except for using the above artificial leather. The resulting artificial full grain leather had a flexibility of 3 and a buckling resistance of 3.0. Results are given in Table 1.

Comparative Example 2

Raw Stock

Island Component Polymer and Sea Component Polymer

The same island component polymer and sea component polymer as adopted in Example 1 were used.

Spinning and Stretching

Except for using a sea-island type composite spinneret with 8 islands per hole and 70 inner seas per island, which had 8 islands, each containing 70 islands of the inner sea component, sea-island type composite fiber with a fineness of 11.3 dtex, and ultrafine fiber with a fiber diameter of 10.5 μm, the same procedure as in Example 1 was carried out to produce raw stock of sea-island type composite fiber from the above sea component polymer and island component polymer.

Nonwoven Fabric

The above raw stock was processed according to the same procedure as in Example 1 to provide nonwoven fabric.

Artificial Leather

A sheet material, artificial leather, and artificial leather (product) were produced by carrying out the same procedure as in Example 1 except for using the above nonwoven fabric. The inner sea component in the ultrafine fiber was not dissolved completely and the resulting artificial leather (product) had a poor flexibility ranked as 2. Its Martindale abrasion weight loss was 5.1 mg and the surface quality was ranked as 3.1. Results are given in Table 1.

Artificial Full Grain Leather

Artificial full grain leather was produced by carrying out the same procedure as in Example 1 except for using the above artificial leather. The resulting artificial full grain leather had a flexibility of 2 and a buckling resistance of 2.5. Results are given in Table 1.

Comparative Example 3

Raw Stock

Island Component Polymer and Sea Component Polymer

The same island component polymer and sea component polymer as adopted in Example 1 were used.

Spinning and Stretching

Except for using a sea-island type composite spinneret with 16 islands per hole and 1 inner sea per island, which had 16 islands, each containing 1 island of the inner sea component, sea-island type composite fiber with a fineness of 4.2 dtex, and ultrafine fiber with a fiber diameter of 4.4 μm, the same procedure as in Example 1 was carried out to produce raw stock of sea-island type composite fiber from the above sea component polymer and island component polymer.

Nonwoven Fabric

The above raw stock was processed according to the same procedure as in Example 1 to provide nonwoven fabric.

Artificial Leather

A sheet material, artificial leather, and artificial leather (product) were produced by carrying out the same procedure as in Example 1 except for using the above nonwoven fabric. The resulting artificial leather (product) had a poor flexibility ranked as 3. Its Martindale abrasion weight loss was 6.3 mg and the surface quality was ranked as 4.0. Results are given in Table 1.

Artificial Full Grain Leather

Artificial full grain leather was produced by carrying out the same procedure as in Example 1 except for using the above artificial leather. The resulting artificial full grain leather had a flexibility of 3 and a buckling resistance of 2.0. Results are given in Table 1.

Comparative Example 4

Raw Stock

Island Component Polymer and Sea Component Polymer

The same island component polymer and sea component polymer as adopted in Example 1 were used.

Spinning and Stretching

Except for using a sea-island type composite spinneret with 16 islands (containing no inner seas) per hole, which had no inner sea component, sea-island type composite fiber with a fineness of 4.7 dtex, and ultrafine fiber with a fiber diameter of 4.4 μm, the same procedure as in Example 1 was carried out to produce raw stock of sea-island type composite fiber from the above sea component polymer and island component polymer.

Nonwoven Fabric

The above raw stock was processed according to the same procedure as in Example 1 to provide nonwoven fabric.

Artificial Leather

A sheet material, artificial leather, and artificial leather (product) were produced by carrying out the same procedure as in Example 1 except for using the above nonwoven fabric. The resulting artificial leather (product) had a poor flexibility ranked as 3. Its Martindale abrasion weight loss was 6.0 mg and the surface quality was ranked as 3.6. Results are given in Table 1.

Artificial Full Grain Leather

Artificial full grain leather was produced by carrying out the same procedure as in Example 1 except for using the above artificial leather. The resulting artificial full grain leather had a flexibility of 3 and a buckling resistance of 2.5. Results are given in Table 1.

TABLE 1

| | Characteristics of artificial leather (product) | | | | | | | Characteristics of artificial full grain leather | |
|---|---|---|---|---|---|---|---|---|---|
| | Average monofilament diameter of ultrafine hollow fiber (μm) | Number of hollows in ultrafine hollow fiber | Density ($g/cm^3$) | Mass ($g/m^2$) | Flexibility | Martindale abrasion weight loss (mg) | Martindale abrasion Surface quality | Flexibility | Buckling resistance |
| Example 1 | 4.4 | 4 | 0.290 | 275 | 5 | 6.5 | 4.7 | 5 | 4.5 |
| Example 2 | 5.5 | 4 | 0.286 | 272 | 5 | 6.2 | 4.6 | 5 | 4.5 |
| Example 3 | 7.0 | 6 | 0.284 | 270 | 4 | 6.0 | 4.1 | 4 | 4.5 |
| Example 4 | 8.6 | 48 | 0.281 | 267 | 4 | 5.7 | 3.7 | 4 | 4.0 |
| Example 5 | 2.5 | 3 | 0.293 | 280 | 5 | 7.9 | 4.6 | 5 | 3.5 |
| Example 6 | 1.5 | 2 | 0.295 | 281 | 4 | 8.9 | 4.5 | 4 | 3.5 |
| Example 7 | 4.4 | 4 | 0.273 | 260 | 5 | 7.9 | 4.3 | 5 | 3.5 |
| Example 8 | 4.4 | 4 | 0.284 | 270 | 5 | 7.6 | 4.4 | 5 | 4.0 |
| Example 9 | 4.4 | 4 | 0.284 | 270 | 5 | 8.7 | 4.2 | 4 | 3.5 |
| Comparative Example 1 | 10.5 | 6 | 0.288 | 274 | 3 | 5.4 | 3.3 | 3 | 3.0 |
| Comparative Example 2 | 10.5 | 70 | 0.303 | 275 | 2 | 5.1 | 3.1 | 2 | 2.5 |
| Comparative Example 3 | 4.4 | 1 | 0.307 | 290 | 3 | 6.3 | 4.0 | 3 | 2.0 |
| Comparative Example 4 | 4.4 | 0 | 0.354 | 336 | 3 | 6.0 | 3.6 | 3 | 2.5 |

The invention claimed is:

1. Sheet material comprising an elastic polymer and a nonwoven fabric containing ultrafine hollow fibers with an average monofilament diameter of 0.05 to 6 pm, the ultrafine hollow fibers having a fiber cross section containing 3 or 4 hollows.

2. Sheet material as set forth in claim 1 that is artificial leather having a nap at least on one surface.

3. Sheet material as set forth in claim 1 that is artificial leather having a grained surface layer.

4. A method of producing sheet material as set forth in claim 1 comprising:

forming ultrafine hollow fibers from composite fibers having a structure in which less soluble island component regions are present in more soluble sea component regions and more soluble inner sea component regions are present in the less soluble island component regions.

5. A method of producing sheet material as set forth in claim 2 comprising:

forming ultrafine hollow fibers from composite fibers having a structure in which less soluble island component regions are present in more soluble sea component regions and more soluble inner sea component regions are present in the less soluble island component regions.

6. A method of producing sheet material as set forth in claim 3 comprising:

forming ultrafine hollow fibers from composite fibers having a structure in which less soluble island component regions are present in more soluble sea component regions and more soluble inner sea component regions are present in the less soluble island component regions.

* * * * *